US005325756A

United States Patent [19]

Sugden

[11] Patent Number: 5,325,756

[45] Date of Patent: Jul. 5, 1994

[54] STRINGED MUSICAL INSTRUMENT

[75] Inventor: David B. Sugden, Kingston Beach, Australia

[73] Assignee: Gondwana Musical Instrument Company Pty. Ltd., Tasmania, Australia

[21] Appl. No.: 920,287

[22] PCT Filed: Dec. 12, 1991

[86] PCT No.: PCT/AU91/00576

§ 371 Date: Oct. 13, 1992

§ 102(e) Date: Oct. 13, 1992

[87] PCT Pub. No.: WO92/10829

PCT Pub. Date: Jun. 25, 1992

[30] Foreign Application Priority Data

Dec. 13, 1990 [AU] Australia ..... PK 3884

[51] Int. Cl.[5] ..... G10D 1/02

[52] U.S. Cl. ..... 84/277; 84/276; 84/307

[58] Field of Search ..... 84/274, 275, 276, 277, 84/298, 299, 307

[56] References Cited

U.S. PATENT DOCUMENTS

| | | | |
|---|---|---|---|
| 91,029 | 6/1869 | Lenhard | 84/277 |
| 878,124 | 2/1908 | D'Armon | 84/277 |
| 1,881,311 | 10/1932 | Currier | 84/275 |
| 2,489,169 | 6/1946 | Virzi | 84/274 |
| 4,291,607 | 9/1981 | Kauffman | 84/299 |
| 4,512,231 | 4/1985 | Mink | 84/277 |
| 5,208,408 | 4/1993 | Cave | 84/277 |

FOREIGN PATENT DOCUMENTS

| | | |
|---|---|---|
| 2618624 | 11/1977 | Fed. Rep. of Germany . |
| 2740605 | 3/1979 | Fed. Rep. of Germany . |
| 135246 | 9/1929 | Switzerland . |
| 853647 | 10/1978 | U.S.S.R. . |

*Primary Examiner*—Michael L. Gellner
*Assistant Examiner*—P. J. Stauzione
*Attorney, Agent, or Firm*—Stevens, Davis, Miller & Mosher

[57] ABSTRACT

A musical instrument of the stringed kind having a hollow sound box formed of a top plate, bottom plate and side walls. A string supporting bridge is mounted on the top plate and has two feet which are spaced apart transversely of the instrument. A sound post extends between the top and bottom plates and is connected to one foot of the bridge through an opening formed in the top plate. The opening and the connection are related so that there is no impediment to movement of the top plate in the region of the opening. By way of example, the post may extend through the opening to effect the connection with the bridge foot, in which event clearance will be provided between the post and the opening.

13 Claims, 4 Drawing Sheets

STRINGED MUSICAL INSTRUMENT

BACKGROUND OF THE INVENTION

This invention relates to musical instruments of the stringed kind. By way of example, the invention is applicable to musical instruments such as the violin, viola, cello, bass, guitar and mandolin. It will be convenient, however, to hereinafter describe the invention with particular reference to violins.

Violin manufacture is a highly specialised art requiring the use of special timbers and the application of special skills which require many years to achieve. As a consequence, the violins of only a few manufactures are recognised as satisfactory for use by concert musicians, and those violins are extremely expensive. Even violins of lesser quality, however, are expensive because of the care and time involved in their manufacture.

The quality of sound derived from a particular violin rests largely on the skill with which certain internal components have been manufactured and installed. Those components include a bridge support bar and a sound post. The bar is usually called the bass bar and is secured to the underside of the top plate or belly of the sound box of the instrument so as to extend longitudinally of the instrument. The bar is of relatively heavy section and is positioned under the foot of the bridge which is adjacent the "G" string, or the string of lowest pitch. The sound post is generally a slender rod of round cross-section which is wedged between the top and bottom plates of the sound box at a location beneath the foot of the bridge which is adjacent the "E" string, or the string of highest pitch.

Each of the two components mentioned above must be manufactured of suitable material, formed to a correct size, and accurately located within the sound box in order to enable the instrument to generate quality sound. Substantial skill is required to achieve those objectives.

Due to the construction of the traditional violin, the top and bottom plates are forced to move in a very complex manner when activated by the strings of the instrument. For this reason, correct selection of the timber for those plates is very critical. The standard manufacturing dimensions of violins have been perfected over a period of 400 years and those dimensions apply to produce satisfactory results only if a timber of a very specific kind is used. That type of timber has always been in limited supply, but it is now becoming increasingly difficult to secure and that which is available is often of poor quality or inadequately seasoned. It is also very expensive.

SUMMARY OF THE INVENTION

It is an object of the present invention to provide a method of manufacturing a stringed musical instrument, and particularly such an instrument having a sound box, which enables production of high quality instruments at a cost significantly lower than that involved in manufacturing traditional instruments and which enables use of materials other than those which have been traditionally used in the manufacture of such instruments. It is a further object of the invention to provide a stringed musical instrument of improved form and high quality.

A musical instrument according to the present invention is characterized in that one of the two feet of the bridge is supported by a post which is in turn supported at a lower end by the bottom plate of the instrument sound box. The connection between the bridge and the post is effected through an opening formed in the top plate of the instrument, and either the post or the bridge may extend through the opening for that purpose. The arrangement is such that the upper end of the post engages a foot of the bridge, and that engagement may be direct or indirect. It is preferred that clearance exists between the top plate opening and whatever passes through it, so that there is no hinderance to flexing of the belly of the instrument. Such flexing is essential to achieving quality sound of adequate volume.

Apart from providing support for one foot of the body, the support post functions as the sound post of the instrument. In prior constructions, the sound post places a constraint on movement of the top plate of the sound box, and that has provided a significant problem in the manufacturing process. In particular, it is one of the factors which dictates the nature of the materials used.

The other foot of the bridge may be supported by the sound box top plate as in the past, and a bass bar may be located on the underside of the top plate directly beneath that other foot as in the past. If desired, the bass bar may be omitted or reduced in size because it may not be necessary for the belly or top plate to twist about that bar as it does in traditional instruments. Also, in some constructions the bass bar need not be directly beneath the foot of the bridge, but could be located to one side of that foot.

Furthermore, in an instrument according to the invention, the relative positions of the support post and the bass bar may be the reverse of that adopted in traditional instruments. That is, the post could be below or close to the bridge foot which is adjacent to the lowest pitch or "G" string, and the bass bar could be below or close to the other or high pitch string foot of the bridge. The manufacturer can select a relative positioning of the post and bass bar which is appropriate for the particular instrument under construction.

The bass bar may be straight or curved, and may be made from any suitable material including wood and aluminium. A stiff relatively light weight material which can be fastened in place by adhesive is generally preferred. If desired, the bass bar may be in the form of a continuous loop which follows a contour line on the underside of the belly to give greater overall stiffness to the belly.

Flexible means may be included in the bridge support of which the support post forms part, so as to impart a degree of vertical cushioning to the bridge support. By way of example, the lower end of that post may engage a lever which is able to flex towards and away from the top plate of the sound box. Furthermore, the upper end of the support post may be attached to the bridge in such a way as to permit some degree of relative angular movement.

BRIEF DESCRIPTION OF THE DRAWINGS

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

In the drawings.

DETAILED DESCRIPTION OF PREFERRED EMBODIMENTS

Figure 1:
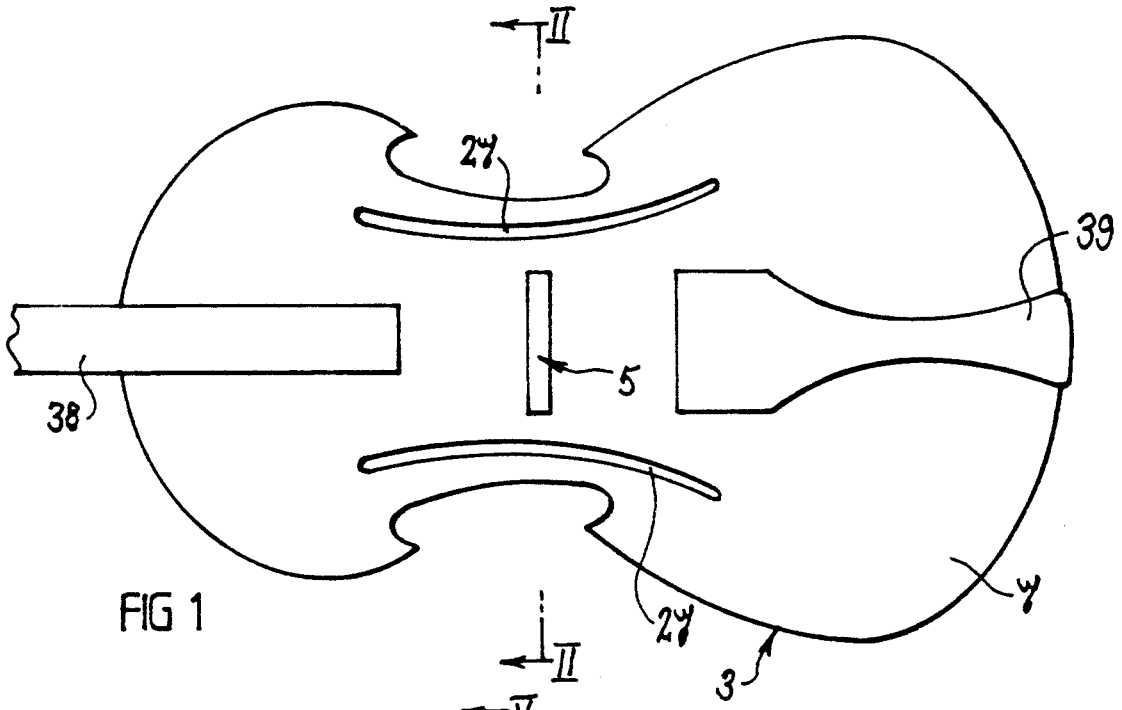
FIG. 1 is a semi diagrammatic top plan view of a violin with parts omitted for convenience of illustration.
Figure 2:
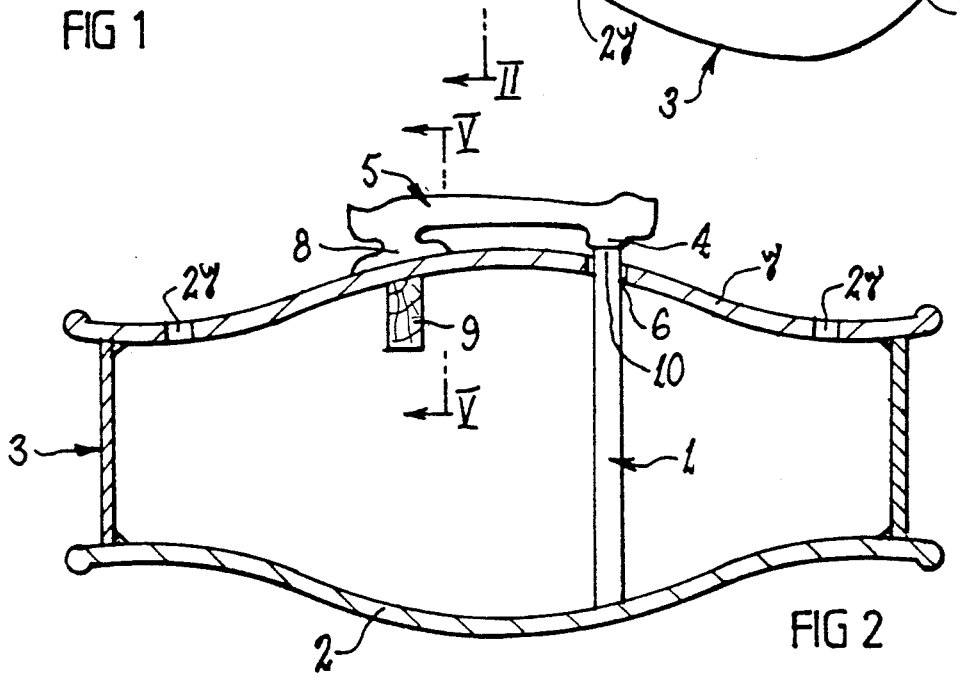
FIG. 2 is a cross-sectional view taken along line II—II of FIG. 1, and showing one embodiment of the invention.

FIGS. 1 and 2 show, in diagrammatic form, part of a violin which incorporates an embodiment of the invention. The strings have been omitted in those Figures for convenience of illustration. As best seen in FIG. 2, a support post 1 extends between the bottom plate 2 of the sound box 3 and a foot 4 of the bridge 5. That post 1 is connected to the foot 4 through an opening 6 provided in the top plate 7. In the arrangement shown, that connection is effected by extending the post 1 through the opening 6, and there is preferably some clearance between the opening 6 and the post 1 for the reason previously stated. Another foot 8 of the bridge 5 rests on the upper surface of the top plate 7, and a bass bar 9 is secured to the undersurface of the plate 7 directly beneath the bridge foot 8.

The arrangement of FIGS. 1 and 2 is a relatively simple application of the invention and is open to substantial variation without departing from the inventive concept. By way of example, the post 1 may terminate beneath the top plate 7 and the foot 4 may extend through the opening 6 to make the connection between that foot and the post 1. The post 1 can be of any suitable material and cross-sectional size and shape, and is intended to substitute for the sound post of conventional instruments.

Figure 3:
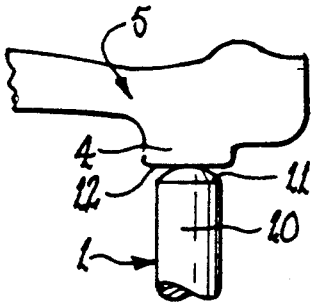
FIG. 3 is an enlarged view of the connection between the sound post and the bridge as shown in FIG. 2.

It is preferred, but not essential that the sound post 1 is located beneath that end of the bridge 5 which supports the "G" string, or the string of lowest pitch. It is further preferred that the connection between the bridge foot 4 and the post 1 allows some degree of relative angular movement between them. In that respect, the upper end 10 of the post 1 may provide a fulcrum for the bridge foot 4. One relatively simple arrangement for achieving that function is shown in FIG. 3. In that arrangement, the top end surface 11 of the post 1 is formed part spherical, whereas the engaging surface 12 of the foot 4 is relatively flat.

If desired, the post upper end 10 may be formed integral with the bridge foot 4, but in that event it will usually be desirable to somehow provide for a degree of relative angular movement between the post 1 and the bridge 5. Alternatively, the post 1 may be attached to the foot 4 illustrates, in diagrammatic form, a flexible connection 13 which permits variation in the relative angular relationship between the post 1 and the bridge 5. That connection 13 can be formed in any appropriate fashion. It may be a flexible joint, a knuckle joint, or any other type of connection which allows for the desired relative angular movement.

Although FIG. 2 indicates that the bar 9 is made of timber, it can be made of aluminium or any other rigid relatively lightweight material which can be secured in place by adhesive. Also, as previously stated, it can be in the form of a continuous loop rather than a bar as such.

Figure 5:
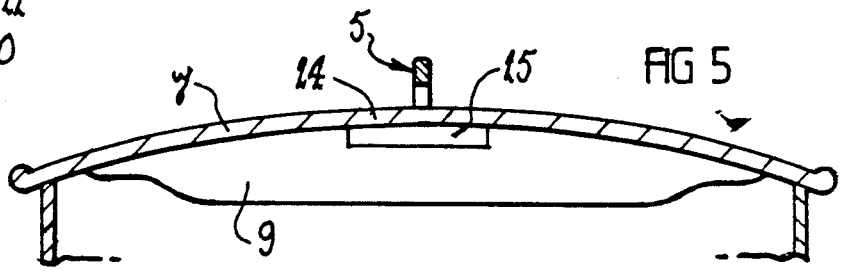
FIG. 5 is a cross-sectional view taken along line V—V of FIG. 2.

If the bass bar 9 is located directly beneath the bridge foot 8 as shown in FIG. 2, it is preferred that the portion 14 of the top plate immediately below the foot 8 is left unsupported as shown in FIG. 5. In particular, a recess 15 may be formed in the upper side of the bar 9 so that the bar 9 does not engage the underside of the top plate 7 over a zone immediately adjacent the bridge 5. That zone extends both forward and rearward of the bridge 5 as shown.

Figure 6:
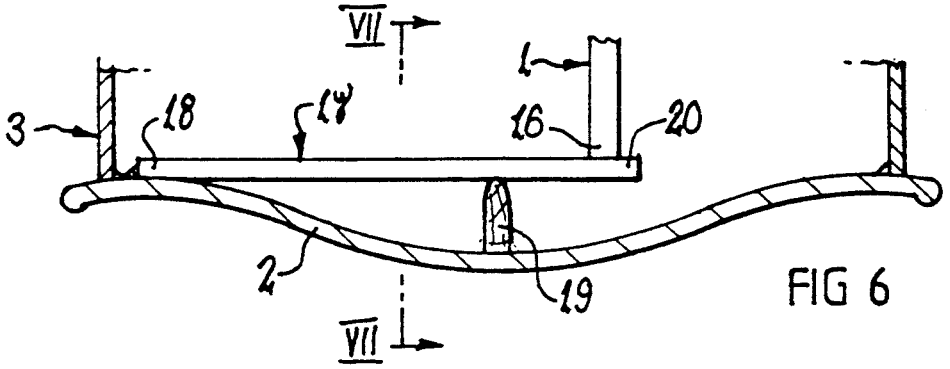
FIG. 6 is a view similar to FIG. 2 but showing the bottom section only of the sound box, and also showing another embodiment of the invention.
Figure 7:
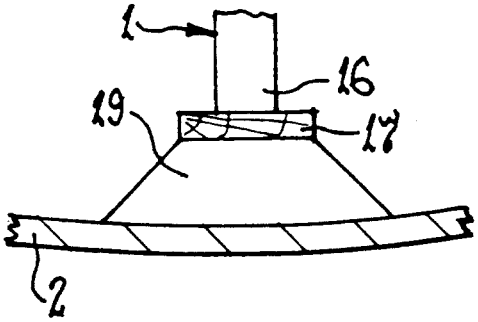
FIG. 7 is a cross-sectional view taken along lines VII—VII of FIG. 6.
Figure 4:
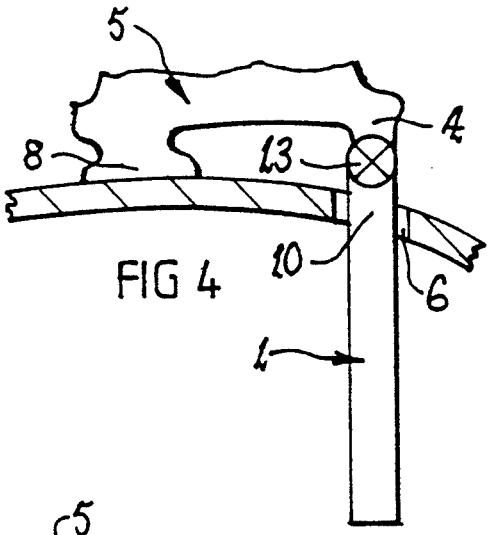
FIG. 4 is a view similar to FIG. 3, but showing in diagrammatic form a variation of the connection between the bridge and the post.

Flexible means may be provided in the support for the bridge foot 4, and one way of achieving that is shown by FIGS. 6 and 7. In the arrangement of FIGS. 6 and 7, the lower end 16 of the post 1 is attached to the bottom plate 2 through a flexible lever 17. One end 18 of the lever 17 is secured to the sound box 3, and a fulorum member 19 is positioned between the bottom plate 2 and the lever 17 at a location between the lever ends 18 and 20. The lower end 16 of the post 1 engages, and is possibly attached to, the lever 17 at a location outboard of the fulcrum member 19 as shown in FIG. 6. The relative locations of the fulcrum member 19, the lever end 18, and the post end 16, can be selected according to requirements.

The arrangement of FIGS. 6 and 7 imparts a degree of vertical cushioning for the bridge foot 4, and that can be beneficial to the quality of sound generated by the instrument. It will be apparent that the same objective might be achieved with other arrangements.

Figure 8:
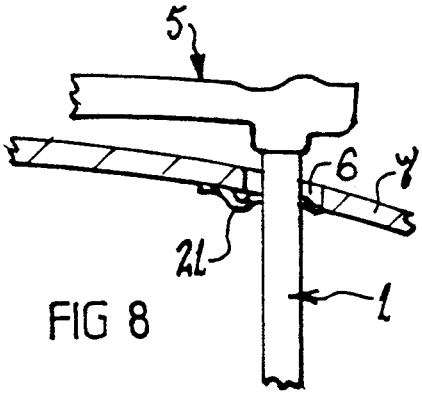
FIG. 8 is a view similar to FIG. 4 but showing another embodiment.
Figure 9:
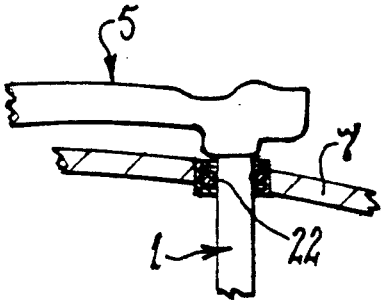
FIG. 9 is a view similar to FIG. 4 but showing still another embodiment.

Means may be provided to close the annular clearance space between the opening 6 and the post 1 without inhibiting movement of the top plate 7 as previously referred to. FIG. 8 shows one such means in the form of a flexible diaphragm 21 which is attached to the top plate 7 and frictionally engages around the post 1. FIG. 9 shows an alternative arrangement in which a resilient O-ring 22 is used in place of the diaphragm 21 of FIG. 8. Other arrangements are clearly available.

Figure 10:
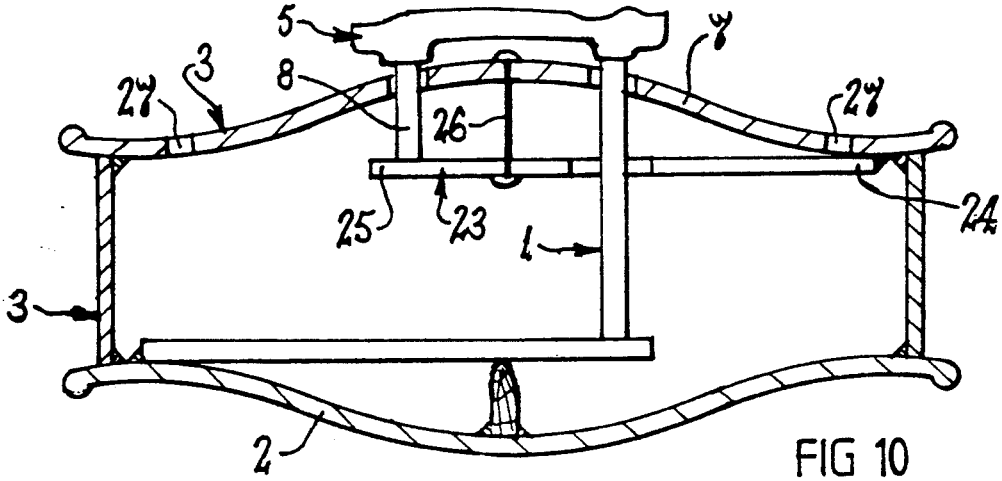
FIG. 10 is a view similar to FIG. 2 and showing a further embodiment of the invention.

A variation of the FIG. 2 arrangement is shown in FIG. 10. In that variation, the bridge foot 8 is supported by flexible means similar to that shown in FIG. 3 as applied to the bridge foot 4. That is, a flexible lever 23 is attached at one end 24 to the sound box 3, and the lever 23 is engaged by the foot 8, or an extension thereof, at or adjacent its other end 25. A fulcrum 26 is provided at a suitable location between the lever ends 24 and 25. Other flexible means could be adopted in place of that particularly shown and described.

In any embodiment of the invention, the traditional f-holes in the top plate 7 may be replaced by holes 27 (FIG. 1) of relatively simple form and which may be located further outboard of the bridge 5 than the f-holes of traditional violins. Such an arrangement ensures that the arch of the instrument belly can be maintained for the full length of the sound box 3. The shape of the holes 27 need not be precisely as shown in FIG. 1. Other shapes could be adopted as required.

The f-holes in the top plate or belly of a violin provide a means for venting the interior air chamber. In a construction according to the present invention, the holes 27 may not be adequate for that purpose in which event a further vent hole, or further vent holes, may be provided at a convenient location such as at one or both sides of the violin body. The number, size and location of the vent holes can be selected as appropriate to achieve such venting of the interior air space as is necessary to properly control the resonance and damping of the chamber.

Figure 12:
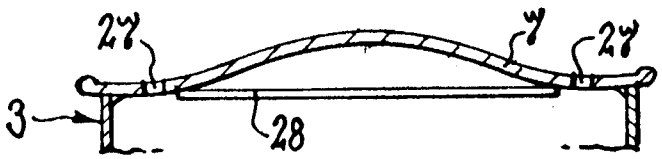
FIG. 12 is a cross-sectional view taken along line XII—XII of FIG. 11.
Figure 11:
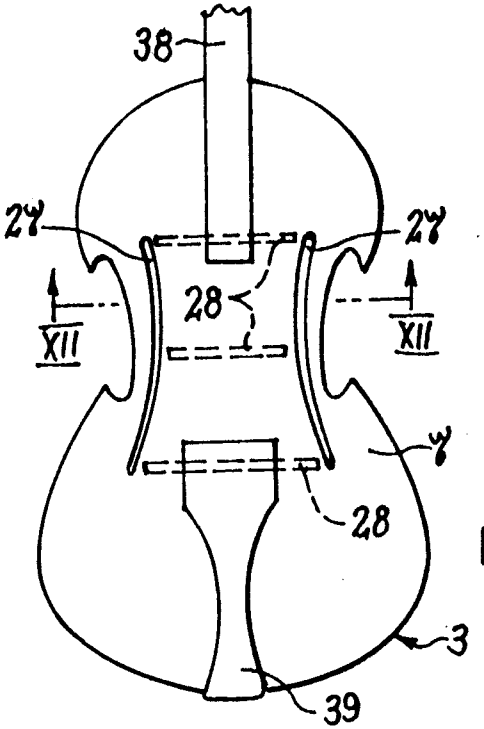
FIG. 11 is a view similar to FIG. 1 and showing still another embodiment of the invention.

The arch of the belly may be stiffened by securing one or more transverse tension members 28 to the underside of the top plate 7 as shown, by way of example, in FIGS. 11 and 12. The size, material and location of each such tension member 28 can be selected to suit requirements. By way of example such tension members could be made of wood or light weight metal such as aluminum.

Figure 13:
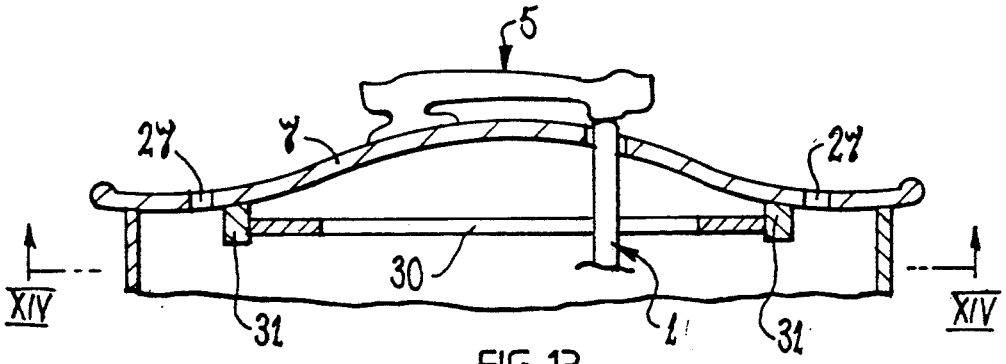
FIG. 13 is a view similar to FIG. 12 and showing yet another embodiment of the invention.
Figure 14:
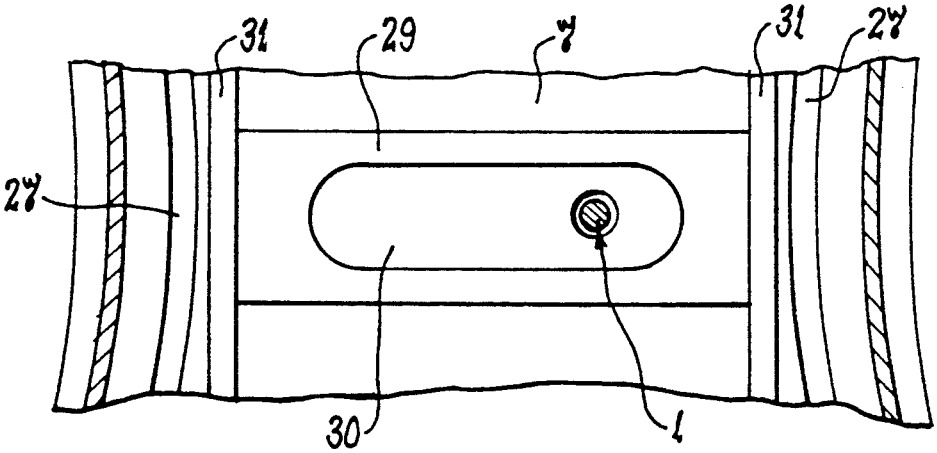
FIG. 14 is a view taken along line XIV—XIV of FIG. 13.

FIGS. 13 and 14 show one particularly satisfactory way of stiffening the belly of the instrument. In that arrangement, a transverse tension member 29 is located directly beneath the bridge 5. The member 29 is preferably relatively wide as shown in FIG. 14, and is cut-away to reduce its weight and to also provide an aperture 30 through which the post 1 extends, preferably without interference. The ends of the member 29 are secured to the underside of the top plate 7 in any appropriate manner. Also, the material of which the member 29 is made may be selected as described above.

The particular arrangement shown in FIGS. 13 and 14 includes two bass bars 31, each of which extends generally in the longitudinal direction of the instrument and is located adjacent a respective one of the f-holes, or equivalent holes 27. In that arrangement, it is convenient to attach each end of the tension member 29 to a respective one of the bars 31. The bass bar 31 remote from the post 1 is optional and may be omitted in some constructions.

Although a single transverse tension member 29 may be satisfactory in many cases, additional transverse tension members may be included as required and located as considered appropriate. Such additional member may or may not be of the same construction as the member 29.

Figure 15:
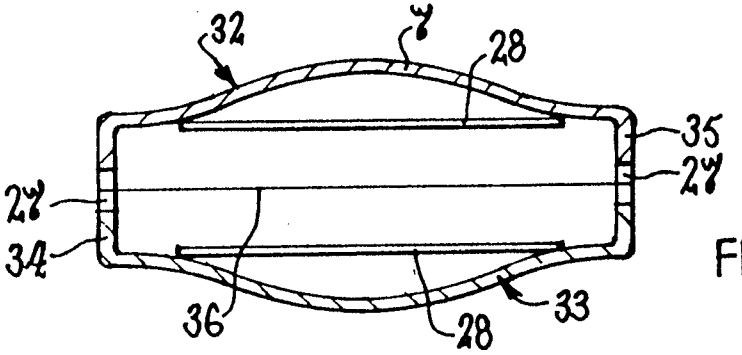
FIG. 15 is a view similar to FIG. 12 and showing another method of constructing the sound box of the instrument.

It is possible to manufacture the body of the sound box 3 of an instrument incorporating the invention, in a manner quite different from that adopted for traditional violins. As shown in FIG. 15, the sound box 3 may be composed of two substantially identical half sections 32 and 33 which are joined along a separation line 36 midway in the height of the side walls 34 and 35 of the sound box 3. The half sections 32 and 33 can be composed of any suitable material.

As also shown in FIG. 15, the openings 27 can be transferred to the side walls 34 and 35, rather than being in the top plate 7.

Figure 16:
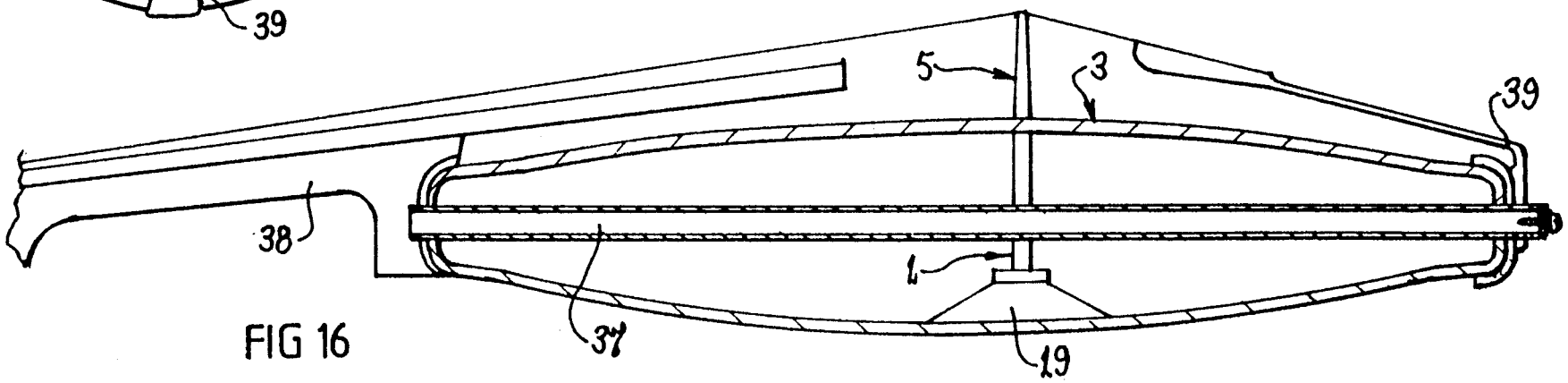
FIG. 16 is a longitudinal cross-sectional view of an instrument made in accordance with yet another embodiment of the invention.

FIG. 16 is a longitudinal cross-sectional view of another embodiment in which an elongate reinforcing member 37 is located within the chamber of the sound box 3 and extends longitudinally of that box. It is preferred that the member 37 is substantially central of the box in terms of both its width and depth. The member 37 may be a bar, rod, or tube, formed of any suitable material and of any suitable dimensions.

The member 37 may form part of a connection between the sound box 3, the finger board 38 and the tail block 39. That is, it may pass through the opposite ends of the box 3 to be secured, preferably in a releasable fashion, at its opposite ends to the finger board 38 and the tail block 39 respectively. Any suitable means may be used for that purpose, with the result that the finger board 38, sound box 3 and tail block 39 are clamped together and can be separated as required for replacement and/or repair.

It will be apparent from the foregoing description that the invention provides a relatively simple form of construction which enables stringed musical instruments of high quality to be manufactured at a substantially reduced cost. Since the belly and the back of the instrument are freed from the restraint of the sound post which exists in traditional instruments, they can be made from a much wider range of materials, and particularly materials which are readily available and less expensive than those used in traditional instruments.

Various alternations, modifications and/or additions may be introduced into the constructions and arrangements of parts previously described without departing from the spirit or ambit of the invention as defined by the appended claims.

I claim:

1. A musical instrument of the stringed kind including, a sound box having top and bottom plates which are spaced apart, a string supporting bridge positioned over the top plate and having one of two opposite ends connected to said top plate, said one end being adjacent the string of said instrument of highest pitch, a sound post extending between said top and bottom plates and having a lower end connected to said bottom plate, an opening in said top plate, a connection between an upper end of said post and the other said end of the bridge such that said end is supported by the upper end of the post, said connection being effected through said opening and arranged so as to not impede movement of the top plate towards and away from the bottom plate, a bass bar connected to the underside of said top plate and extending transverse to said bridge, said bass bar being located so that said one end of the bridge is located between the bass bar and the sound post and is spaced from the bass bar, and a tension member extending across the undersurface of said top plate in substantially the longitudinal direction of said bridge and having each of two opposite ends secured to said top plate at locations beyond the ends of said bridge.

2. An instrument according to claim 1, wherein an upper end portion of said post extends through said opening so as to effect said upper end connection, and clearance exists between said opening and said upper end portion.

3. An instrument according to claim 2, wherein a flexible annular diaphragm extends across said clearance to close said opening without inhibiting movement of said top plate relative to said post.

4. An instrument according to claim 1, wherein said upper end connection is such that relative angular movement is permitted between said upper end of the post and said other end of the bridge.

5. An instrument according to claim 1, wherein said connection involves direct engagement between said post and said bridge.

6. A musical instrument according to claim 1, wherein said tension member is located directly beneath said bridge and has an aperture therein through which said sound post extends with clearance.

7. An instrument according to claim 1, wherein an end of said tension member is attached to said bass bar.

8. An instrument according to claim 1, wherein said lower end of the post is connected to the bottom plate through a flexible post supporting lever which extends transverse to said post, one end of said lever is attached to said sound box and an opposite end portion thereof is engaged by the lower end of said post, a fulcrum is connected to said bottom plate, and said lever extends over said fulcrum and engages the fulcrum at a location between said post and said one end of the lever.

9. An instrument according to claim 1, wherein said one end of the bridge is connected to said top plate through a flexible bridge supporting lever which extends transverse to said post and is located within said sound box.

10. A musical instrument according to claim 1, wherein a further bass bar is connected to the undersurface of said top plate, said further bass bar extending substantially in the same direction as the first said bass bar, and said further bass bar is located so that said other end of the bridge is positioned between the two said bars and is spaced from each.

11. An instrument according to claim 10, wherein there are two f-holes in said top plate and each is located adjacent a respective longitudinal side of said sound box, and there are two said bass bars, each of which is located adjacent a respective said f-hole.

12. A musical instrument according to claim 10, wherein each said end of the said tension member is connected to a respective one of said bass bars so as to be thereby secured to said top plate.

13. A musical instrument according to claim 1, wherein two f-holes are formed in said top plate adjacent respective opposite sides of said instrument and each said f-hole is located between the adjacent said side and a respective adjacent end of said tension member.

* * * * *